US008443893B1

(12) United States Patent
Finger et al.

(10) Patent No.: US 8,443,893 B1
(45) Date of Patent: May 21, 2013

(54) CLEANING APPARATUS FOR A WELLHEAD ASSEMBLY AND METHOD OF USE THEREOF

(76) Inventors: John W. Finger, Beresford, SD (US); Brad Hyronimus, Beresford, SD (US); Sandro Sanchez, Quito (EC)

( * ) Notice: Subject to any disclaimer, the term of this patent is extended or adjusted under 35 U.S.C. 154(b) by 352 days.

(21) Appl. No.: 12/770,318

(22) Filed: Apr. 29, 2010

Related U.S. Application Data

(60) Provisional application No. 61/175,171, filed on May 4, 2009.

(51) Int. Cl.
*E21B 41/02* (2006.01)

(52) U.S. Cl.
USPC ..... 166/312; 134/199; 15/104.04

(58) Field of Classification Search
USPC 166/311, 312, 88.4, 90.1; 134/199; 15/104.4, 15/104.04
See application file for complete search history.

(56) References Cited

U.S. PATENT DOCUMENTS

| | | | | |
|---|---|---|---|---|
| 1,476,184 | A | 12/1923 | Schrader | |
| 1,521,390 | A * | 12/1924 | Reynolds | 166/312 |
| 1,566,419 | A * | 12/1925 | De Witt et al. | 166/90.1 |
| 3,306,310 | A * | 2/1967 | Grant | 134/122 R |
| 3,334,639 | A * | 8/1967 | Grant | 134/122 R |
| 3,720,264 | A * | 3/1973 | Hutchison | 166/311 |
| 3,943,997 | A * | 3/1976 | Davis | 166/312 |
| 4,169,504 | A * | 10/1979 | Scott | 166/90.1 |
| 4,205,694 | A | 6/1980 | Thompson | |
| 4,279,300 | A * | 7/1981 | Wirsch | 166/90.1 |
| 4,433,639 | A * | 2/1984 | Brown | 118/316 |
| 4,494,607 | A * | 1/1985 | Ford et al. | 166/311 |
| 4,640,372 | A * | 2/1987 | Davis | 175/208 |
| 4,895,205 | A * | 1/1990 | Thompson et al. | 166/90.1 |
| 4,953,496 | A | 9/1990 | Taylor | |
| 5,085,016 | A | 2/1992 | Rose | |
| 5,129,355 | A | 7/1992 | Taylor | |
| 5,205,306 | A | 4/1993 | Peterson | |
| 5,285,968 | A | 2/1994 | McSheehy | |
| 5,385,609 | A | 1/1995 | Rose | |
| 5,577,668 | A | 11/1996 | King | |
| 6,463,943 | B1 | 10/2002 | Monroe | |
| 6,631,858 | B1 | 10/2003 | Farineau | |
| 7,409,995 | B2 * | 8/2008 | Moynahan | 166/311 |

FOREIGN PATENT DOCUMENTS

GB 1343295 A * 12/1974

* cited by examiner

*Primary Examiner* — Kenneth L Thompson
(74) *Attorney, Agent, or Firm* — Jeffrey A. Proehl; Woods, Fuller, Shultz & Smith, P.C.

(57) ABSTRACT

A cleaning apparatus for mounting on a wellhead of a well to spray elements positioned in a central passage of the wellhead. The cleaning apparatus may comprise an annular body including an inner surface defining at least a portion of an aperture through the body, with the annular body defining a fluid channel therein. The apparatus may comprise an inlet fitting on the annular body and in fluid communication with the fluid channel, and a plurality of orifices positioned on the annular body and oriented to direct fluid into the aperture. The orifices may be in fluid communication with the fluid channel such that fluid carried in the fluid channel is moved through the orifices into the aperture. A method is also disclosed, and a wellhead assembly including the cleaning apparatus is also disclosed.

19 Claims, 13 Drawing Sheets

CLEANING APPARATUS FOR A WELLHEAD ASSEMBLY AND METHOD OF USE THEREOF

RELATED APPLICATIONS

This application claims priority to and the benefit of: U.S. Provisional Patent Application Ser. No. 61/175,171, by Finger et al., titled "Cleaning Apparatus For A Wellhead Assembly" filed May 4, 2009, which is incorporated herein by reference in its entirety

BACKGROUND

Field

The present disclosure relates to wellhead assemblies and more particularly pertains to a new cleaning apparatus for a wellhead assembly for cleaning drilling equipment prior to withdrawal of the equipment from the wellhead.

SUMMARY

The present disclosure describes a new cleaning apparatus for a wellhead assembly which may be utilized for cleaning drilling equipment prior to withdrawal of the equipment from the wellhead.

The present disclosure relates to a cleaning apparatus for cleaning drilling equipment, and which may be incorporated into and as a part of the wellhead apparatus of the wellhead such that equipment moved in the wellhead may be cleaned as moved in the well head.

In one aspect, the disclosure relates a method for applying fluid to elements of a well drilling rig as the elements are moved in a wellhead of the well. The method may comprise positioning a cleaning apparatus on a wellhead, with the cleaning apparatus defining an aperture in communication with a central passage of the wellhead through which elements of the drilling rig are moved to exit the well. The method may further comprise positioning at least one element of the drilling rig in the central passage of the wellhead including in the aperture of the cleaning apparatus, and spraying fluid from the cleaning apparatus into the aperture of the apparatus as the at least one element of the drilling rig is positioned in the aperture of the cleaning apparatus on the wellhead.

In another aspect, the disclosure relates a cleaning apparatus for mounting on a wellhead of a well to spray elements positioned in a central passage of the wellhead. The cleaning apparatus may comprise an annular body including an inner surface defining at least a portion of an aperture through the body, the annular body defining a fluid channel therein. The apparatus may comprise an inlet fitting on the annular body and in fluid communication with the fluid channel. The apparatus may also comprise a plurality of orifices positioned on the annular body and oriented to direct fluid into the aperture, the orifices being in fluid communication with the fluid channel such that fluid carried in the fluid channel is moved through the orifices into the aperture.

In still another aspect, the disclosure relates a wellhead assembly with an equipment cleaning apparatus. The assembly may comprise a wellhead assembly defining a central passage through which drilling equipment is moved into and out of the well, with the wellhead assembly comprising at least two stacked elements. The assembly may also include a cleaning apparatus mounted on the wellhead assembly. The cleaning apparatus defines an aperture in communication with the central passage of the wellhead assembly such that elements withdrawn from the wellhead pass through the aperture. The cleaning apparatus may comprise an annular body including an inner surface defining at least a portion of an aperture through the body, with the annular body defining a fluid channel therein. The apparatus may further comprise an inlet fitting on the annular body and in fluid communication with the fluid channel, and a plurality of orifices positioned on the annular body and oriented to direct fluid into the aperture. The orifices may be in fluid communication with the fluid channel such that fluid carried in the fluid channel is moved through the orifices into the aperture.

There has thus been outlined, rather broadly, some of the more important elements of the invention in order that the detailed description thereof that follows may be better understood, and in order that the present contribution to the art may be better appreciated. There are additional elements of the invention that will be described hereinafter.

In this respect, before explaining at least one embodiment or implementation in greater detail, it is to be understood that the scope of the invention is not limited in its application to the details of construction and to the arrangements of the components, or to the particulars of the steps, set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the disclosure be regarded as including such equivalent constructions insofar as they do not depart from the spirit and scope of the present invention.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
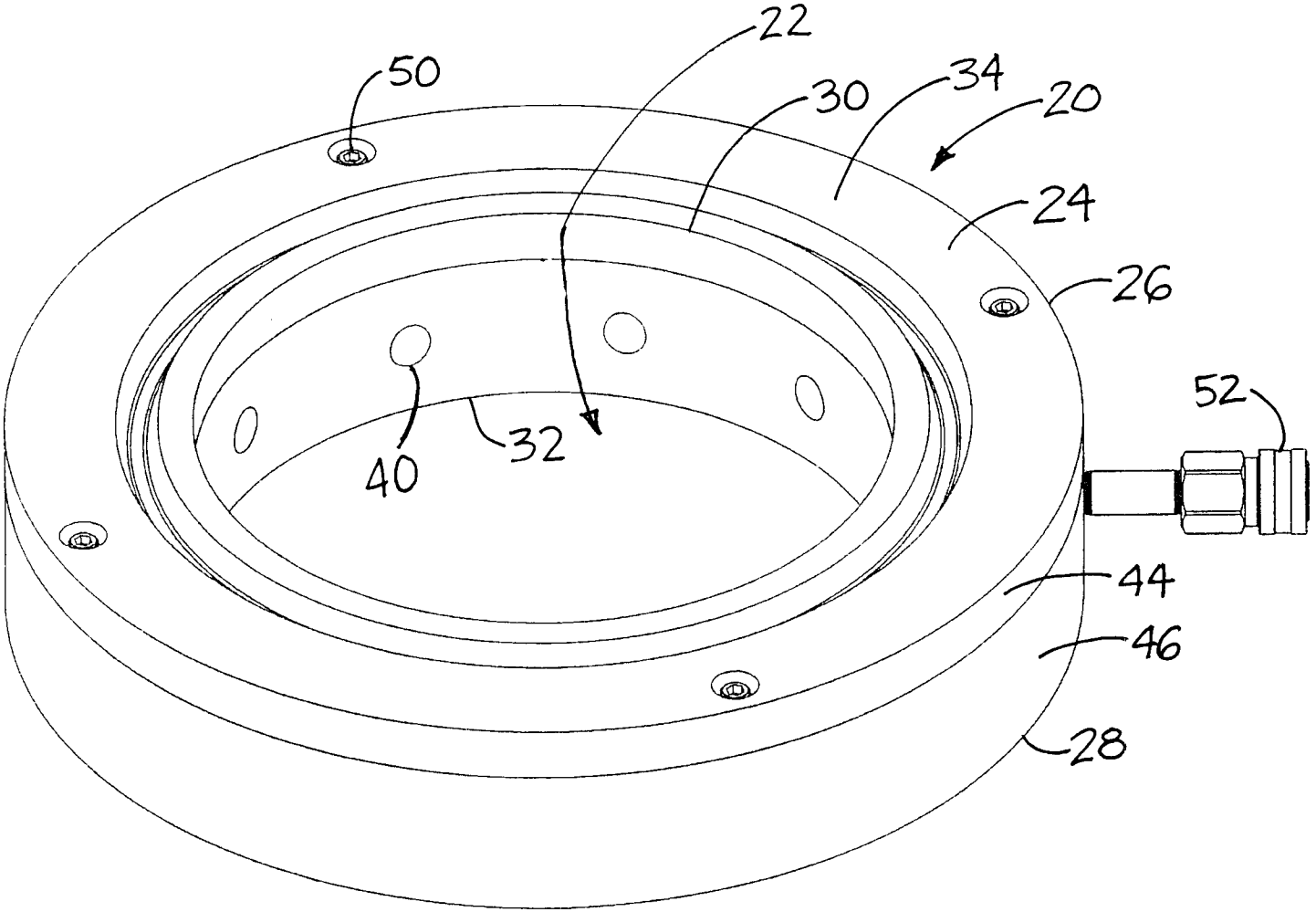
FIG. 1 is a schematic perspective view of a new cleaning apparatus for a wellhead assembly according to the present disclosure.
Figure 2:
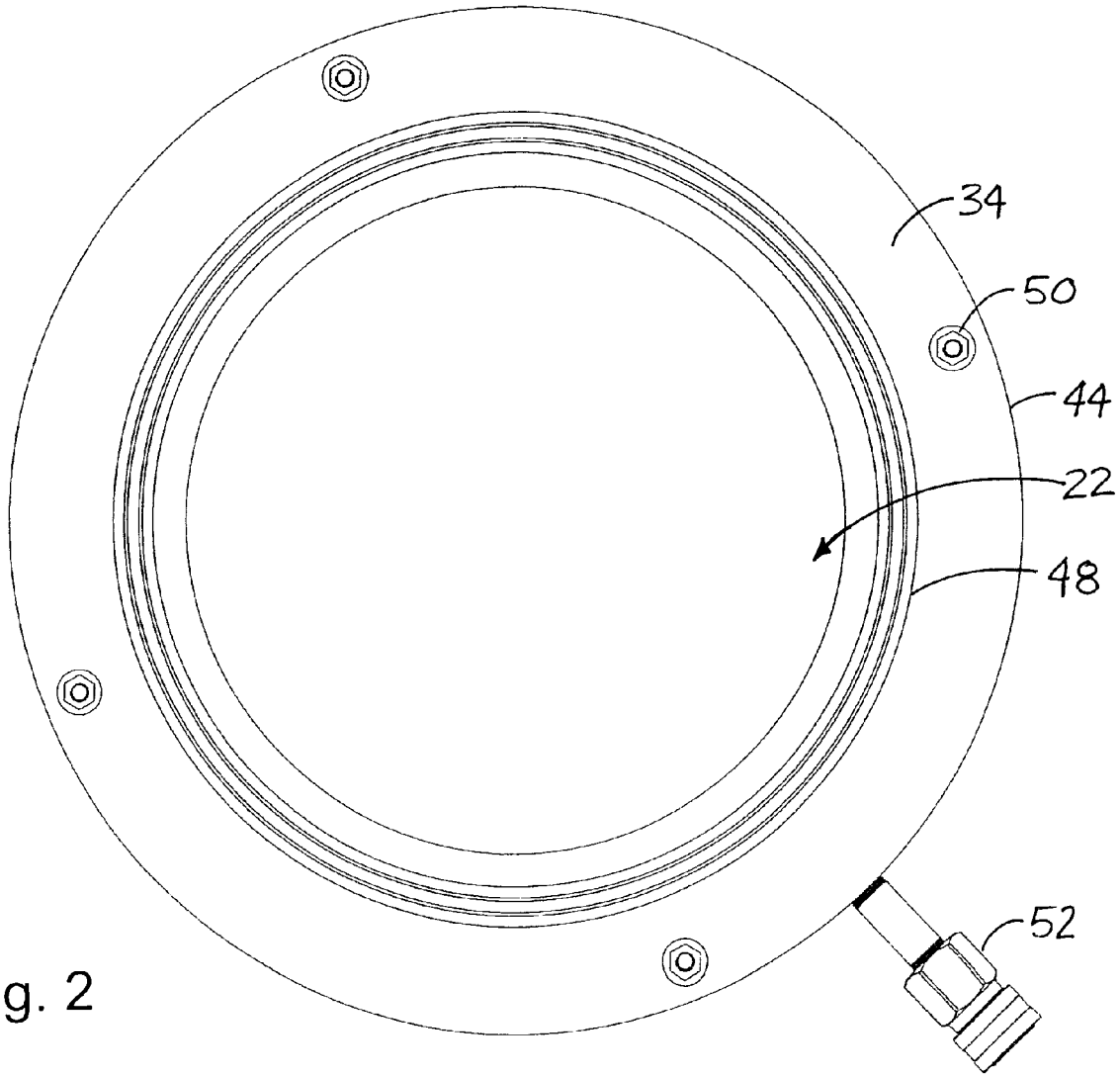
FIG. 2 is a schematic top view of the cleaning apparatus, according to an illustrative embodiment.
Figure 3:
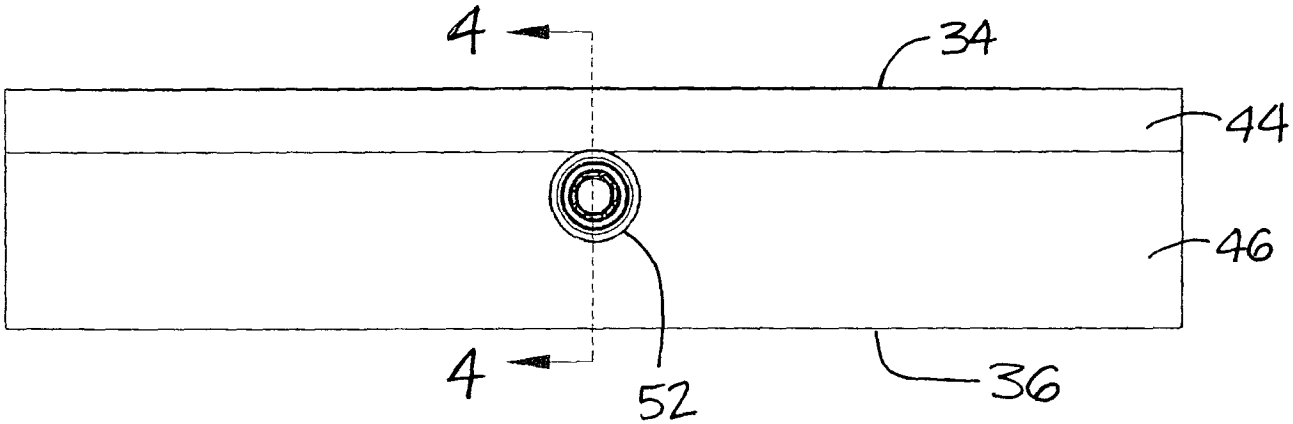
FIG. 3 is a schematic side view of the cleaning apparatus, according to an illustrative embodiment.
Figure 4:
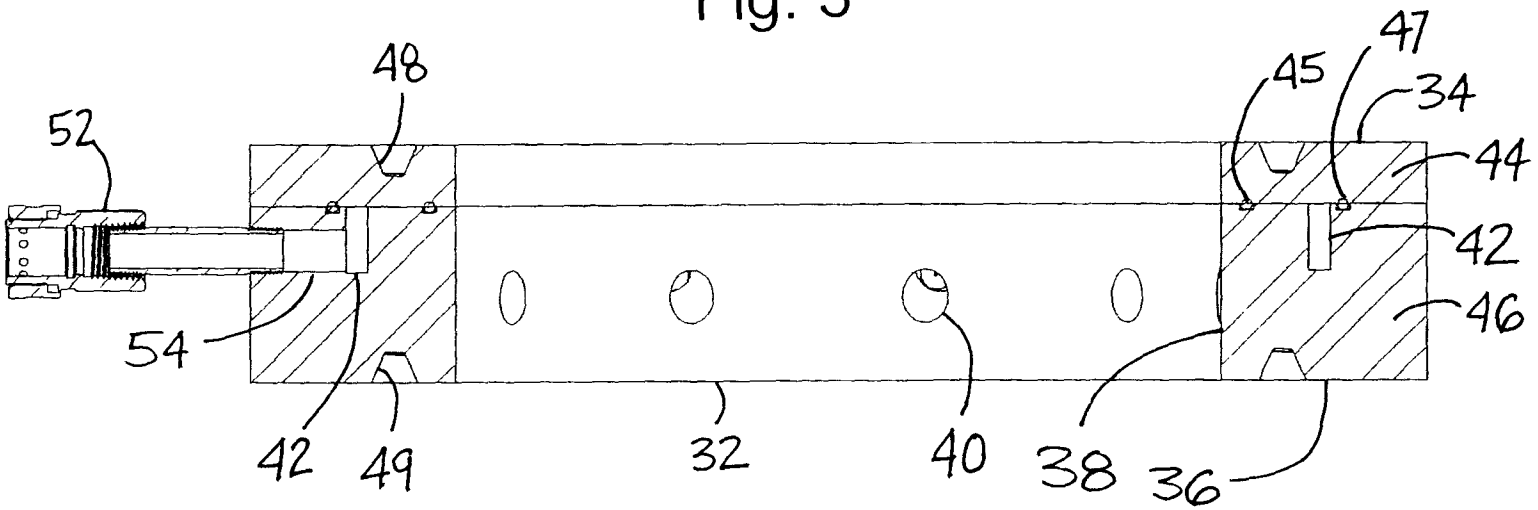
FIG. 4 is a schematic sectional view of the cleaning apparatus taken along line 4-4 of FIG. 3.
Figure 5:
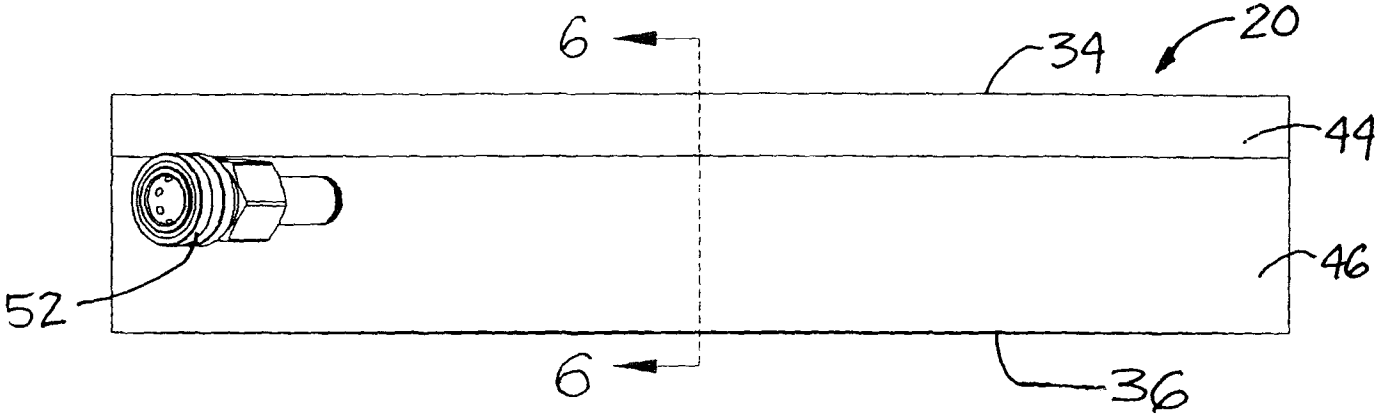
FIG. 5 is a schematic side view of the cleaning apparatus.

With reference now to the drawings, and in particular to FIGS. 1 through 17 thereof, a new cleaning apparatus for a wellhead assembly embodying the principles and concepts of the disclosed subject matter will be described.

In some aspects, the disclosure relates to a wellhead assembly 1 that includes an equipment cleaning apparatus 20. In addition to the cleaning apparatus 20, the wellhead apparatus 1 may include a wellhead assembly 10 that defines a central passage 12 through which drilling equipment is moved into and out of the well. The wellhead assembly may comprise virtually any of the elements that are typically found in a wellhead assembly, including blowout prevention devices, bell nipples, and various other devices positioned atop of the well casing head of the wellhead.

Figure 7:
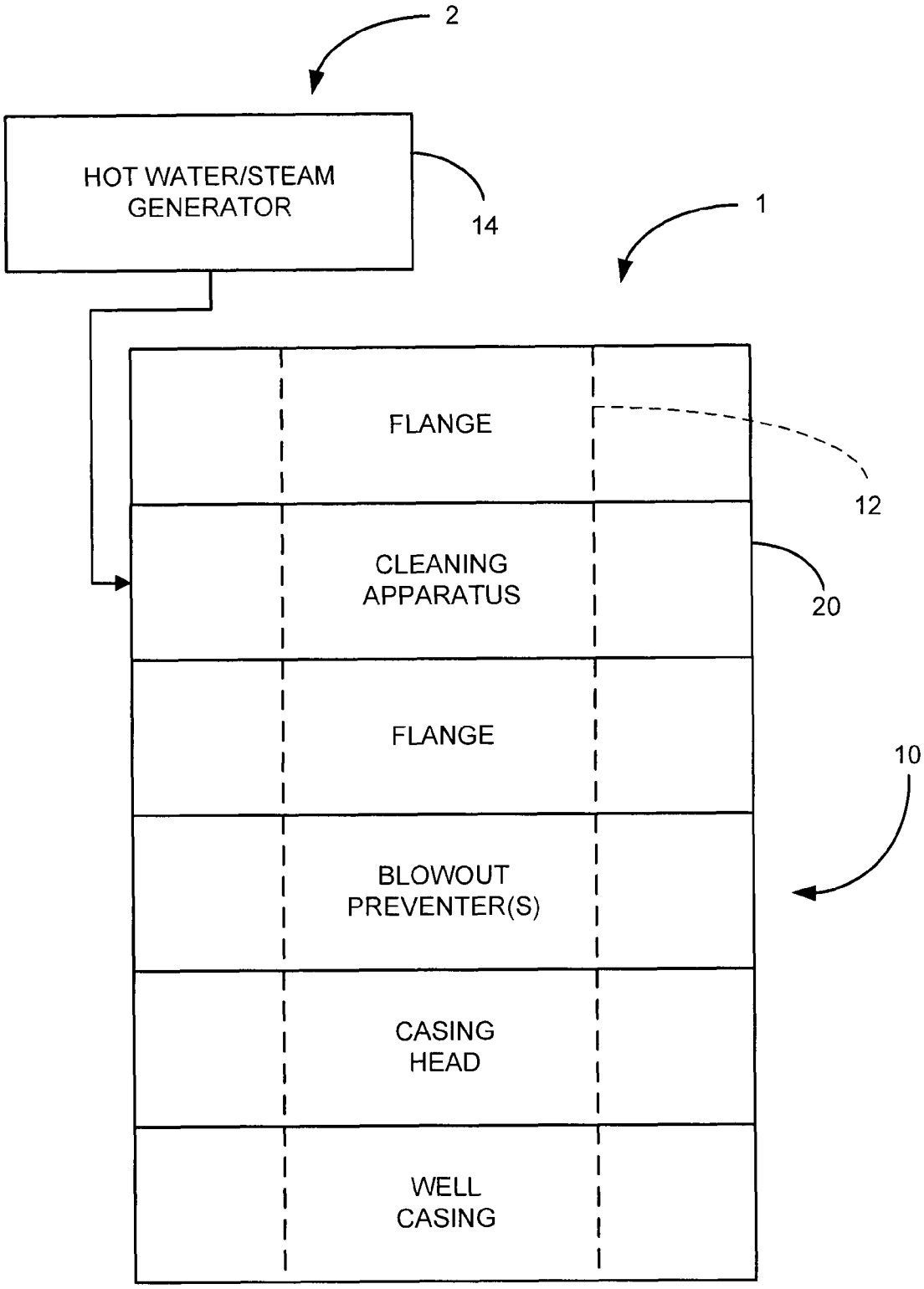
FIG. 7 is a schematic diagram of the cleaning apparatus in a wellhead apparatus according to an illustrative configuration of the disclosure.
Figure 8:
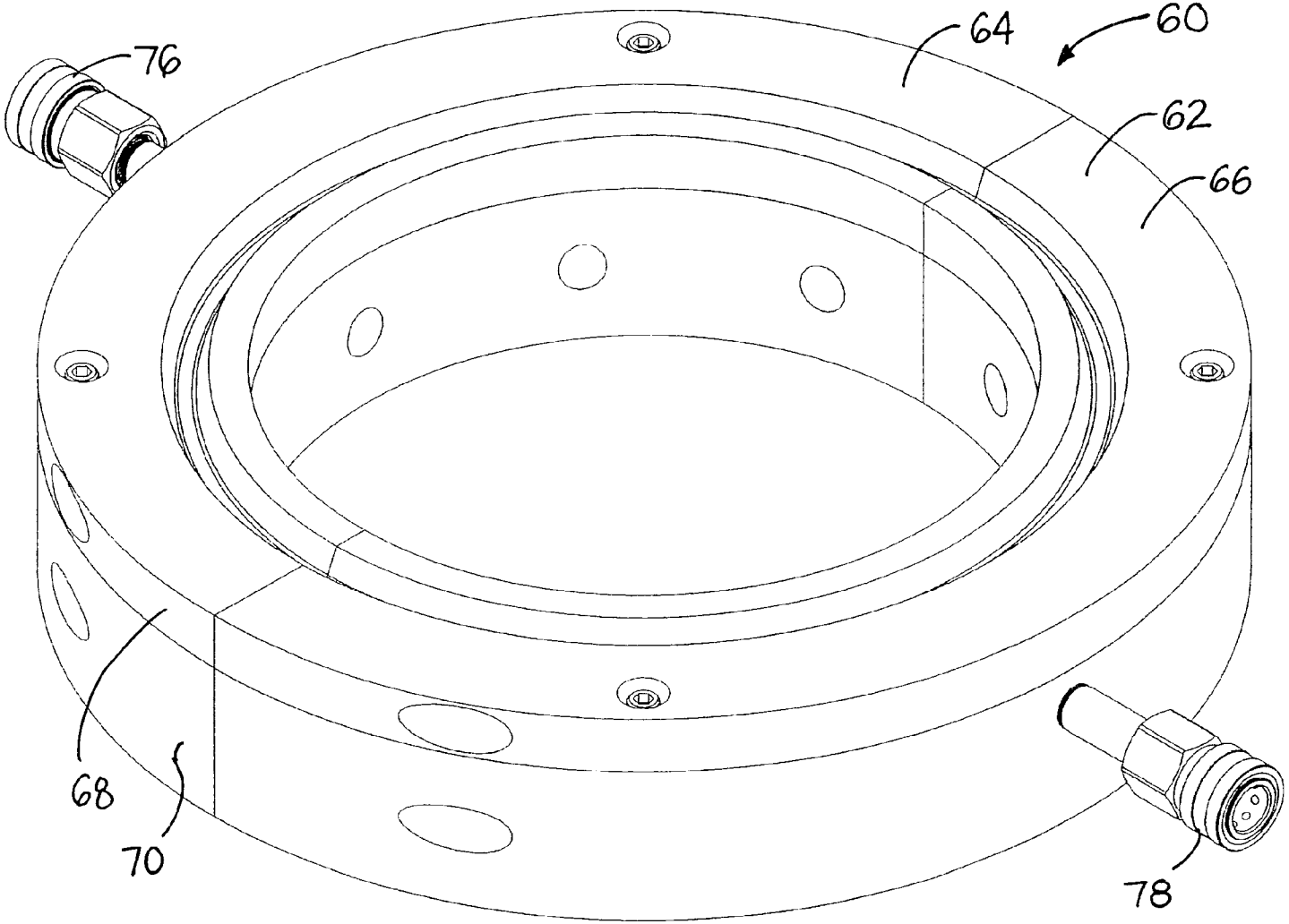
FIG. 8 is a schematic perspective view of another embodiment of the new cleaning apparatus for a wellhead assembly according to the present disclosure.
Figure 9:
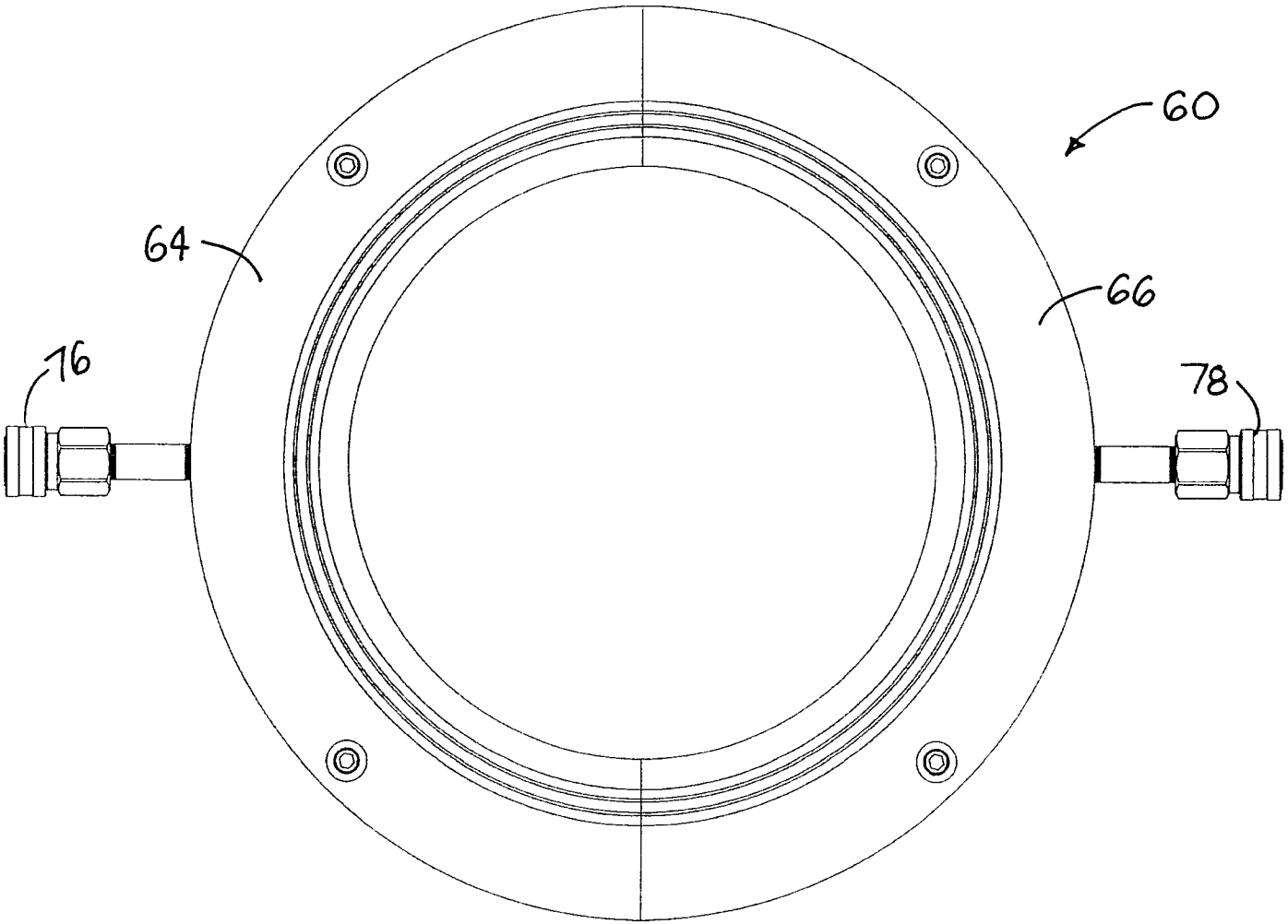
FIG. 9 is a schematic top view of the embodiment of the cleaning apparatus shown in FIG. 8.
Figure 10:
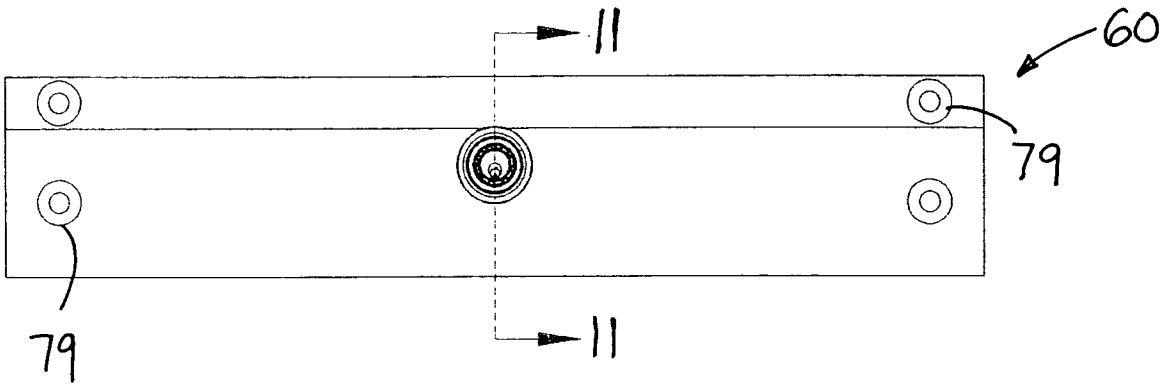
FIG. 10 is a schematic side view of the embodiment of the cleaning apparatus shown in FIG. 8.
Figure 11:
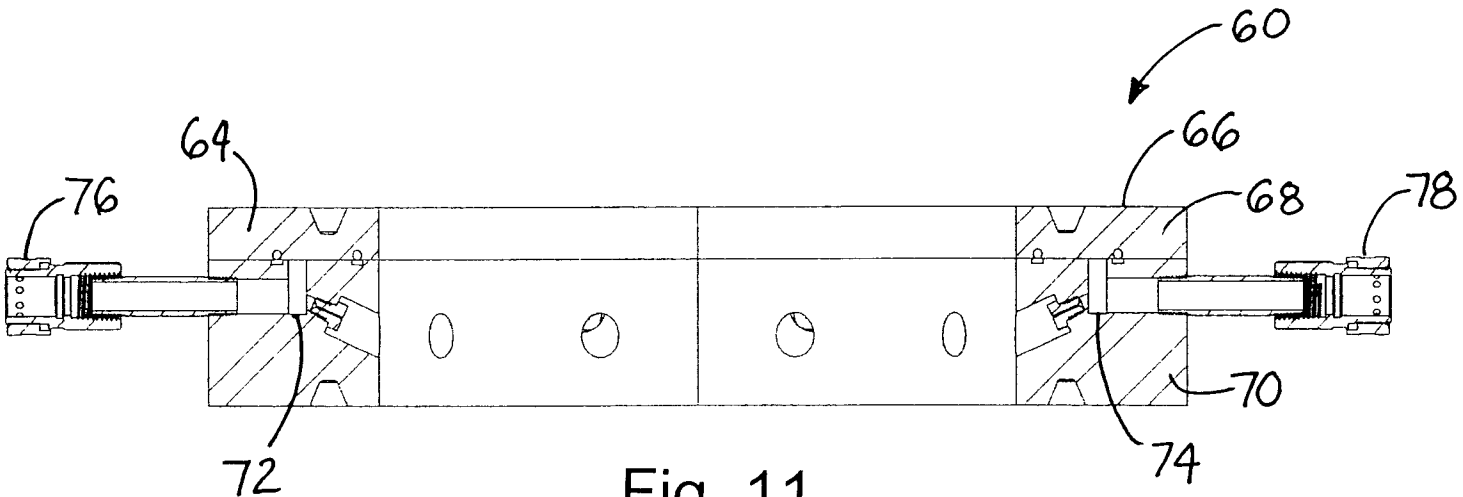
FIG. 11 is a schematic sectional view of the cleaning apparatus taken along line 11-11 of FIG. 10.

The cleaning apparatus 20 may be mounted on the wellhead assembly 10 as a part of the wellhead apparatus 1, such as is schematically depicted in FIG. 7. The cleaning apparatus 20 may be positioned between two mounting flanges, and may be positioned on top of various elements such as, for example, the blowout preventer(s) or the bell nipple, although other positionings may be utilized. The cleaning apparatus 20 defines an aperture 22 that may be aligned or registered with the central passage 12 of the wellhead assembly 10 such that the aperture 22 of the cleaning apparatus is in communication with the central passage 12, and equipment moving through the central passage for the purpose of, for example, drilling the well, also passes through the aperture of the cleaning apparatus 20. Thus, equipment moving through the wellhead apparatus is caused to move through the cleaning apparatus 20.

The cleaning apparatus 20 may comprise a body 24, and the body may be substantially annular in shape about the aperture 22. While the body 24 is illustratively depicted with a round ring shape, it should be recognized that this is not the only shape that the body may have, although a circular shape is one of the most preferred configurations. The cleaning apparatus 20 may include an annular body 24, and the aperture 22 of the cleaning apparatus may extend through the annular body. The annular body 24 may have an upper end 26 and a lower end 28. The upper end 26 may include and define an upper opening 30 and the lower end 28 may include and define a lower opening 32. The aperture 22 may extend between the upper opening 30 and the lower opening 32, and the aperture may have a substantially uniform size and cross sectional shape between the upper and lower openings, although that is not critical to the function of the apparatus 20. The cross sectional shape of the aperture may be substantially circular, although this is also not a critical characteristic of the apparatus. In the illustrative embodiments, the lower opening 32 lies substantially in a plane, and the upper opening 30 may also lie in a plane. The upper end 26 of the body may include an upper face 34 lying substantially in the plane of the upper opening 30, and the lower end 28 of the body may include a lower face 36 lying substantially in the plane of the lower opening 32. The planes of the upper face 34 and the lower face 36 may be substantially parallel to facilitate the stacking of the cleaning apparatus and the wellhead assembly 10 in the wellhead apparatus 1.

The annular body 24 may include an inner surface 38 that defines and bounds at least a portion of the aperture 22 in the cleaning apparatus. The inner surface 38 may be substantially cylindrical in shape, although this is not critical. The diameter of the inner surface 38 may vary to approximate or match the size of other components of the wellhead. For example, the diameter of the inner surface 38 may be approximately 7 inches (approximately 18 cm), approximately 9 inches (approximately 23 cm), and approximately 11 inches (approximately 28 cm). These are merely examples of some diameter sizes of the inner surface, and other sizes, including larger and smaller sizes, may be employed without departing from the invention.

A plurality of orifices 40 may be positioned on the annular body 24 and may be configured to direct a stream of fluid into the aperture 22 such that the stream of fluid exiting the orifice is likely to strike equipment moving through the well head assembly and the cleaning apparatus 20. The orifices 40 may be located on the inner surface 38 of the annular body. The orifices 40 may be substantially uniformly spaced or separated about the circumference of the inner surface 38, although less uniform positioning may be used. The orifices may all be positioned in substantially the same plane that horizontally bisects the body, or some orifices may be positioned vertically higher and some vertically lower with respect to each other. It is believed that the number of orifices in the range of four to twenty are most suitable for the purpose of cleaning, although more or fewer could be utilized. The number of orifices 40 may be adjusted according to the size of the cleaning apparatus, and, for example, the diameter size of the inner surface of the body, with larger diameters requiring greater numbers of orifices, and smaller diameters requiring lesser numbers of orifices. Illustratively, the body 24 includes eight orifices.

Figure 6:
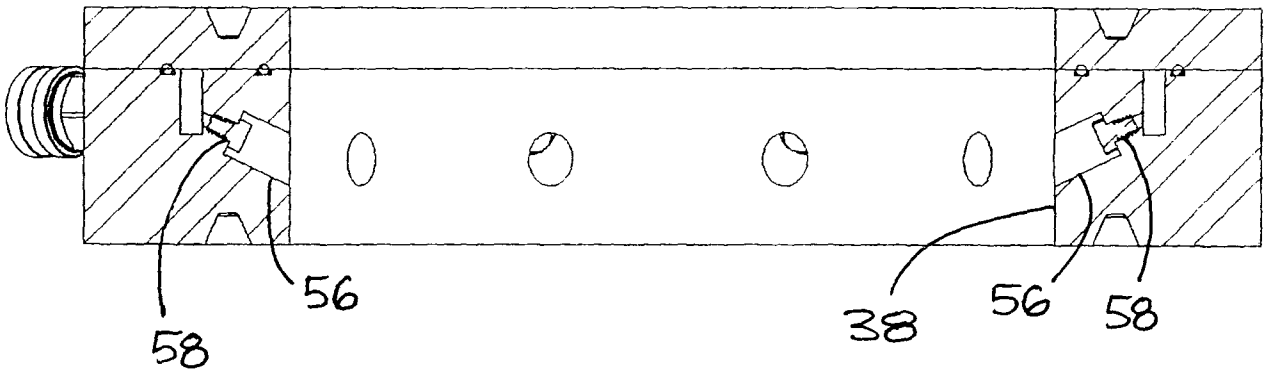
FIG. 6 is a schematic sectional view of the cleaning apparatus taken along line 6-6 of FIG. 5.

In some embodiments, at least some of the plurality of orifices 40 are configured such that a stream of fluid exiting at least two of the orifices converge together (see, e.g., FIG. 6). The plurality of orifices 40 may be configured such that the streams or sprays of fluid exiting the orifices converge or overlap substantially at the same location, and the location of convergence or overlap may be substantially central to the aperture 22, such as a location along a center axis of the aperture. The plurality of orifices 40, or a portion thereof, may be configured such that streams of fluid exiting the orifices converge or overlap at an area located in the aperture between the upper opening 30 and the lower opening 32, but also may be configured such that the streams converge or overlap outside of the space between the planes of the upper and lower openings. Illustratively, the orifices 40 may be configured such that the streams converge or overlap at a location below the lower opening such that fluid of the streams, when striking each other or equipment positioned in the aperture, is most likely to be deflected downwardly into the central passage of the wellhead assembly for recovery by devices such as those designed to recover drilling mud from the wellhead apparatus.

The body 24 of the cleaning apparatus may include a fluid channel 42, and the plurality of orifices 40 may be in fluid communication with the fluid channel such that fluid in the fluid channel is able to reach the orifices. In preferred implementations of the cleaning apparatus 20, the fluid that is directed through the fluid channel 42 and into the orifices is super heated liquid water under high pressure such that when the water flows from the orifices and is exposed to atmospheric pressure, a portion of the water becomes steam, with the remainder of the water remaining in a liquid condition.

Each of the orifices 40 may include an orifice channel 56 that extends from the fluid channel 42 to the inner surface 38 of the body, and opens to the inner surface. The orifice channel 56 may be angled in an inwardly and downwardly direction from the fluid channel to provide the fluid streams that converge at a location that is vertically lower than the vertical level of the orifices when the cleaning apparatus is oriented for use. Each orifice may also include a nozzle 58 that is positioned in the channel 56 to produce a spray of fluid out of the orifice 40 through the inner surface 38. In some embodiments, the nozzle 58 is a separate part that is removably mounted on the body 24, such as for example by threads formed on the nozzle 58 and the orifice channel 56. The nozzle may produce any desired stream or spray geometry. The nozzle 58 may be mounted on the body in the orifice channel such that the stream or spray of fluid exiting the nozzle generally follows the longitudinal axis of the orifice channel. The downward declination angle of the axis of the streams or sprays produced by the nozzles may be in the range of approximately 0 degrees to a horizontal plane to approximately 45 degrees to the horizontal plane, with a range of approximately 15 degrees to approximately 30 degrees being one preferred range. A substantially equal angle of declination for all of the orifices may be preferred, but variation in the angles of different orifices may be utilized.

In greater detail, the annular body 24 of the cleaning apparatus 20 may include an upper portion 44 which includes the upper face 34 of the body, and a lower portion 46 that includes the lower face 36 of the body. An upper interface channel 48 may be formed in the upper face 34 of the body, and may be suitable for receiving a gasket or other sealing element employed to form a seal with an adjacent element in the wellhead apparatus 1. The upper interface channel may be annular and extend about the circumference of the body. A lower interface channel 49 may be formed in the lower face 36 of the body, and may also be suitable for receiving a gasket or other sealing element employed to form a seal with an adjacent element in the wellhead apparatus 1, and may also be annular and extend along the circumference of the body. The lower portion 46 may define at least a portion of the fluid channel 42, although the upper portion may also form at least a portion of the fluid channel, such that when the upper and lower portions are separated, the fluid channel is opened up. An inner sealing gasket 45 and an outer sealing gasket 47 may be positioned between the upper portion 44 and the lower portion 46 when the portions are connected together, with the fluid channel 42 being positioned between the inner 45 and outer 47 sealing gaskets. Suitable channels or grooves may be formed in one or both of the opposing faces of the upper and lower portions to accept and seat the gaskets 45, 47 in the correct positions. The plurality of orifices 40 may be located in the lower portion, and may extend from a lower area of the fluid channel. The upper and lower portions may be removably connected to each other by a plurality of fasteners 50, such as bolts that extend through the upper portion 44 and are threaded into bores in the lower portion 46.

The cleaning apparatus 20 may also include an inlet fitting 52 that is mounted on the body 24. The inlet fitting 52 may be in communication with an inlet channel 54 formed in the body 24 and in communication with the fluid channel 42, such that fluid entering the inlet fitting 52 and the inlet channel is able to reach the fluid channel 42 and the orifices 40.

The cleaning apparatus 20, and the inlet fitting 52 and fluid channel 42, may be supplied with various fluids, including, for example, substantially pure water and specialized cleaning solutions. The fluid may be supplied at a range of temperatures, including, for example, temperatures ranging from approximately 212 degrees Fahrenheit (approximately 100 degrees Celsius) to approximately 400 degrees Fahrenheit (approximately 204 degrees Celsius). The fluid may also be supplied at a range of pressures, including, for example, pressures ranging from approximately 100 psi (approximately 0.68 MPa) to approximately 5,000 psi (approximately 34.5 MPa). The fluid may also be supplied at a range of flow rates, for example, flow rates ranging from approximately 1 gallon per minute (3.8 liters per minute) to approximately 20 gallons per minute (76 liters per minutes). Through various temperature and pressure characteristics, as well as nozzle characteristics, the fluid may be supplied to the nozzles through the fluid passages as a liquid, and may be converted to have a substantial steam component when the fluid exits the nozzles.

In some embodiments, a cleaning system 2 includes the cleaning apparatus 20 as disclosed herein and also includes a heated fluid generator, which will be referred to as a hot water/steam generator 14, although the working fluid is not limited solely to water. The hot water/steam generator 14 may provide heated water or steam to the cleaning apparatus through one or more conduits, which may in turn be moved through the cleaning apparatus via the orifices. In some implementations, the generator 14 provides the hot water or steam in a condition that falls within the aforementioned temperature, pressure, and flow rate ranges for a particular cleaning apparatus configuration having, for example, a particular number of orifices. In other implementations, the generator 14 may be configured to provide the working fluid in the desired parameter ranges for a range of cleaning apparatus sizes having, for example, a variety of numbers of orifices, and has the capability to adjust the pressure and heat applied to the fluid to deliver the fluid in the desired ranges of temperature, pressure and flow rate. This may be accomplished, for example, using a hot water/steam generator 14 that includes a variable frequency drive to vary the speed of a fluid pump to control the pressure and flow rate of the fluid, and a modulating fuel burner to control the amount of heat delivered to the fluid. A PID controller may be utilized to control these elements to achieve the temperature, pressure and flow rate within the desired ranges. The generator 14 may thus be transferred between different cleaning apparatus of different sizes and with a different number of nozzles with different orifice sizes on different wellheads while still providing the fluid with the desired characteristics.

As is illustratively shown in FIGS. 8 through 11, other embodiments of the disclosure include a cleaning apparatus 60 that may have similar features to those previously described. Additionally, the apparatus 60 may have an annular body 62 that includes a first arcuate segment 64 and a second arcuate segment 66 which may be connectable together either directly or indirectly to form the annular body. Such configurations are highly useful for installing the apparatus 60 on the parts of the wellhead while an elongate element, such as drilling pipe, is extending through the wellhead that would otherwise make it difficult to position a cleaning apparatus of a continuous ring nature in the stack of elements on the wellhead. The first 64 and second 66 arcuate segments may each be substantially semicircular such that a substantially circular ring is formed when the segments are connected together, although a perfectly circular shape is not critical to the operation of the apparatus. The arcuate segments 64, 66 may be connectable in an opposed orientation, and the ends of the C-shaped segments may be connectable to form a continuous element about the aperture.

Each of the first 64 and second 66 arcuate segments may include an upper section 68 and a lower section 70, with the upper and lower sections of each respective arcuate segment 64, 66 being connected together to define a fluid channel 72, 74 in each of the segments. In some embodiments, the fluid channel 72 of the first arcuate segment 64 is not in fluid communication with, and is thus separate of fluid connection to, the fluid channel 74 of the second arcuate segment. In such embodiments, an inlet fitting 76, 78 may be provided on each segment so that the first arcuate segment 64 has a first inlet fitting 76 in fluid communication with the fluid channel 72 and the second arcuate segment 66 has a second inlet fitting 78 in fluid communication with the fluid channel 74. Optionally, the fluid channels 72, 74 may be in fluid communication when the segments are assembled together. The segments 64, 66 may be removably connected together by fasteners 79, and for example, the fasteners 79 may pass through a bore extending through one of the segments and engage threads formed on a bore on the other one of the segments so that tightening the fastener on the threads connects the segments together, and loosening the threads allows for the segments to be released from each other. Other means of connection may be utilized without departing from the disclosure.

Figure 12:
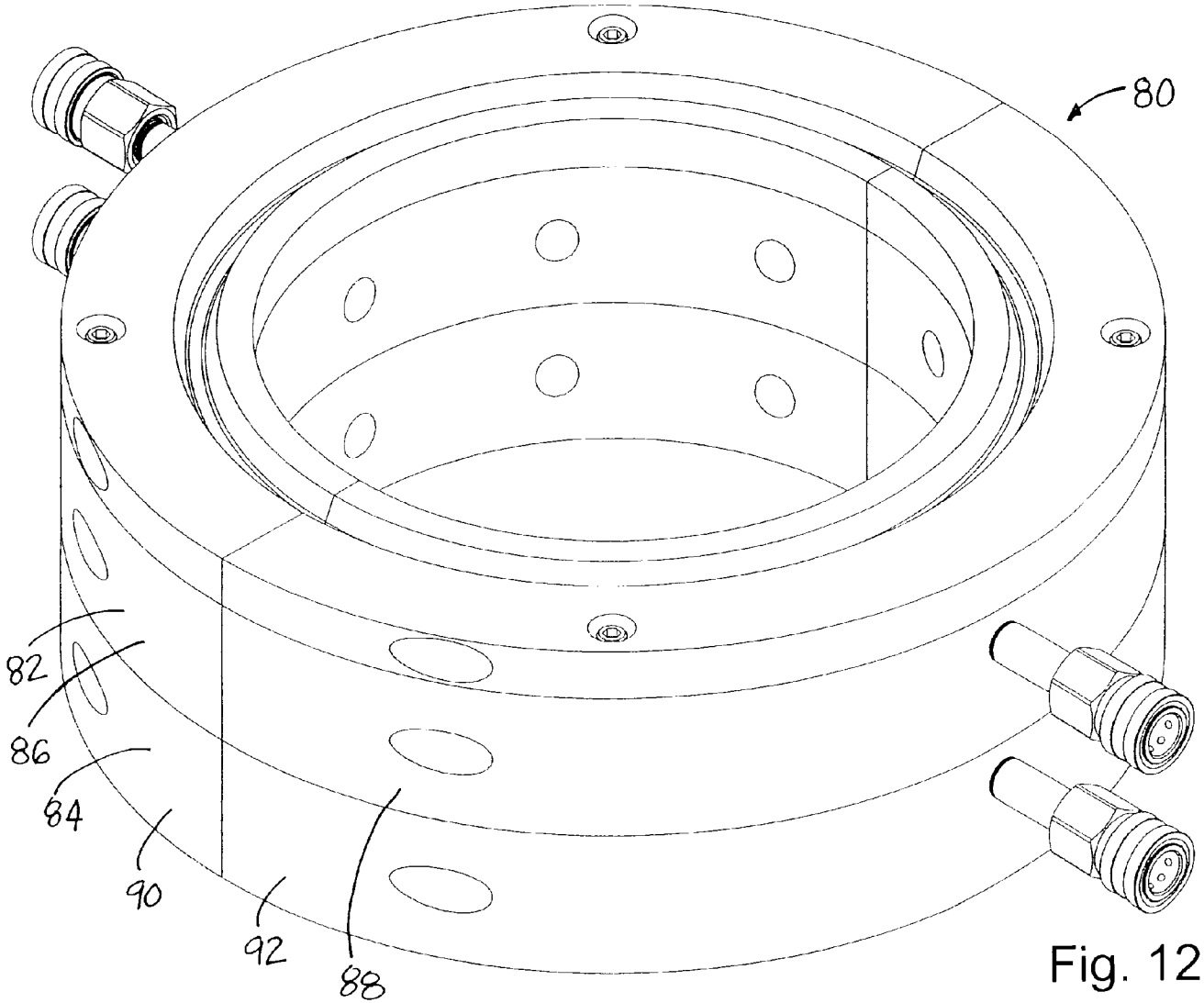
FIG. 12 is a schematic perspective view of multiple cleaning apparatus stacked together.
Figure 13:
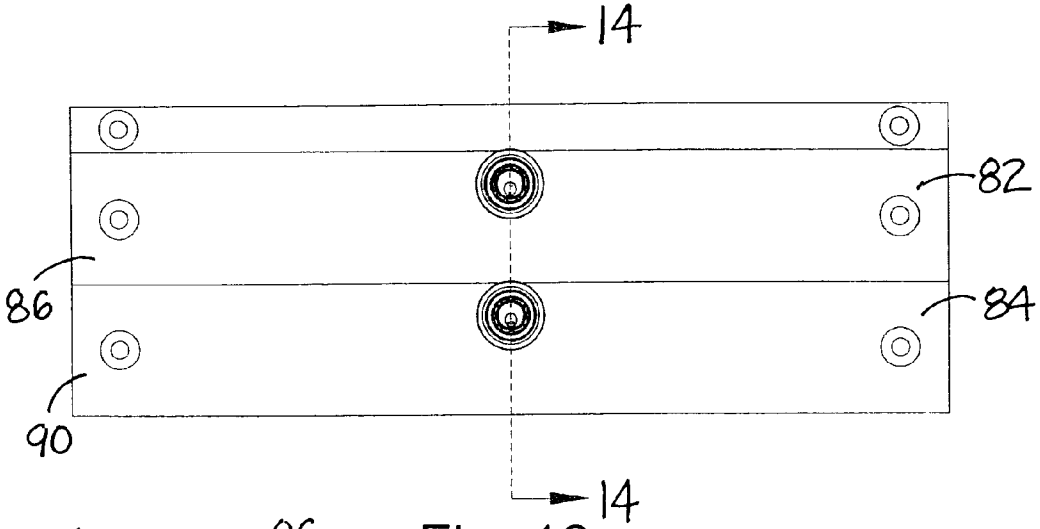
FIG. 13 is a schematic side view of the stacked cleaning apparatus of FIG. 12.
Figure 14:
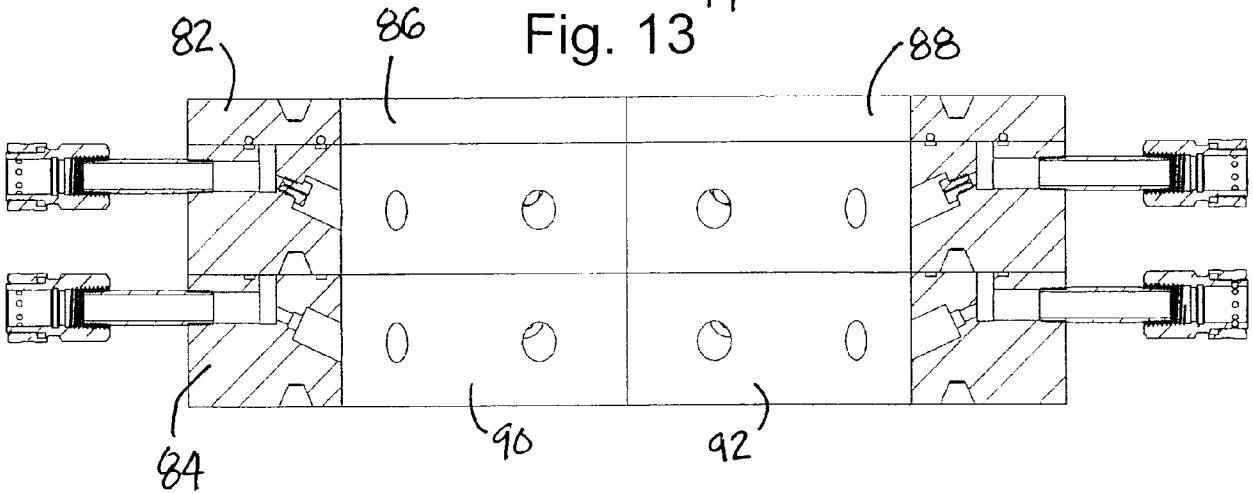
FIG. 14 is a schematic sectional view of the stacked cleaning apparatus taken along line 14-14 of FIG. 13.

As illustratively shown in FIGS. 12 through 14, still other configurations of the disclosure the cleaning apparatus 80 may include a plurality of bodies 82, 84 in a stacked arrangement to provide additional points of fluid flow in an inward direction and located at different vertical levels when the bodies are stacked in a vertical direction. Thus, the amount of fluid that may be brought to bear on an element moving through the aperture may be increased, without having to necessarily increase the size of the streams impinging upon the elements. Moreover, fluids of different compositions may be dispensed through the different bodies. Furthermore, the second body provides a spare to use if any of the orifices in the first body become plugged, so that in the instance of an oil drilling rig, the oil drilling operation does not need to shut down due to the compromised operation of the first body.

The bodies 82, 84 may be substantially identical in construction and shape, or may differ. Optionally, as shown in the Figures, each of the bodies 82, 84 may comprise a pair of segments 86, 88 and 90, 92, respectively, that may be similar in character to the segments 64, 66 described above. Each of the segments may be substantially semicircular in shape, although other shapes may be utilized. Each of the segments 86, 88, 90, 92 may have an inlet fitting for providing fluid to the respective segment, although communication between the fluid channels of the bodies and segments may be utilized. The segments of the bodies may be removably connected together by one or more fasteners as described above.

Figure 15:
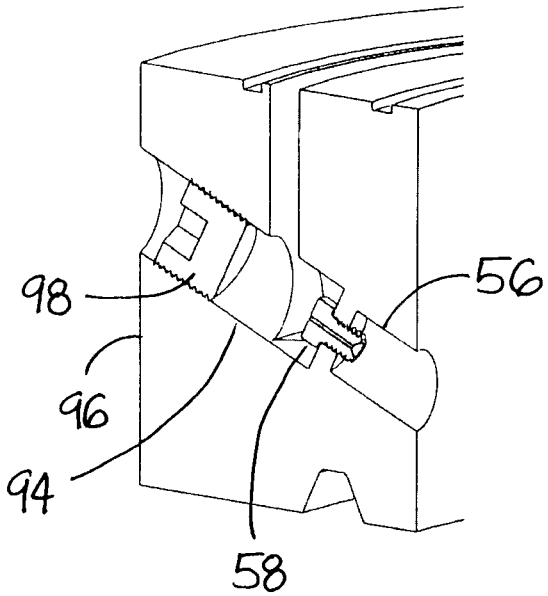
FIG. 15 is a schematic sectional view of a portion of an embodiment of the cleaning apparatus showing a variation in the body of the cleaning apparatus.

As is illustratively shown in FIG. 15, an optional configuration of the body 24, and in some embodiments the lower portion 46 of the body, a nozzle replacement channel 94 may be provided for providing access to the nozzle from the outer surface 96 of the body. The nozzle replacement channel 94 may be formed through the material of the body from the outer surface 96 of the body toward the nozzle 58. The nozzle replacement channel 94 may intersect the fluid channel 42, and may communicate with the orifice channel 56 in which the nozzle is positioned. A plug 98 may be removably positioned in the nozzle replacement channel 94 to close the channel 98 against fluid passage when access to the nozzle is not required, and thus hold the fluid in the fluid channel. The plug 98 may be threaded and engage threads formed on the surface of the channel 94.

Figure 16:
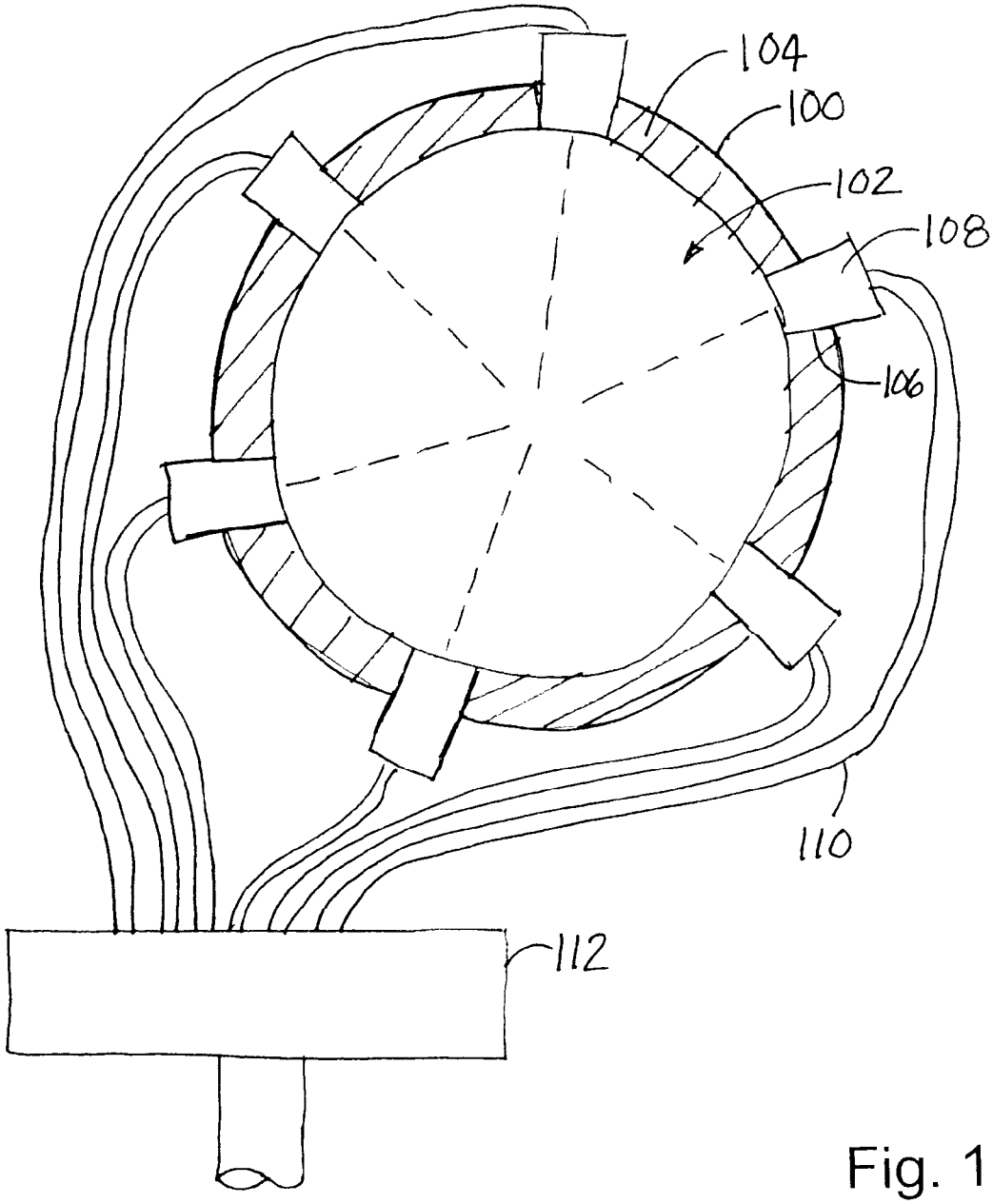
FIG. 16 is a schematic top sectional view of another embodiment of the cleaning apparatus.

As is illustratively shown in FIG. 16, another configuration of the concept of the disclosure includes a pipe 100 or pipe that is suitable for forming a section of the wellhead or drilling apparatus and receiving a portion of a drilling element in the lumen 102 of the pipe. The wall 104 of the pipe 100 may have one of more bores 106 formed through the wall, and the holes may be spaced about the circumference of the wall at substantially equal spacings. A nozzle 108 may be positioned in each of the bores 106 in a manner to direct a stream of fluid inward into the lumen of the pipe. The nozzles may be removably mounted on the wall 104, or may be integrally formed on the wall. The nozzles 108 may be positioned on the wall in any manner, including the configurations set forth in this disclosure. One or more conduits 110 may fluidly connect the nozzles 108 such that fluid carried by the conduits is communicated to the nozzles. The conduits 110 may connect to a manifold 112 to thereby distribute fluid from a fluid source to the one or more conduits. In such configurations, it may be possible to control the flow from the nozzles on an individual basis if desired.

Figure 17:
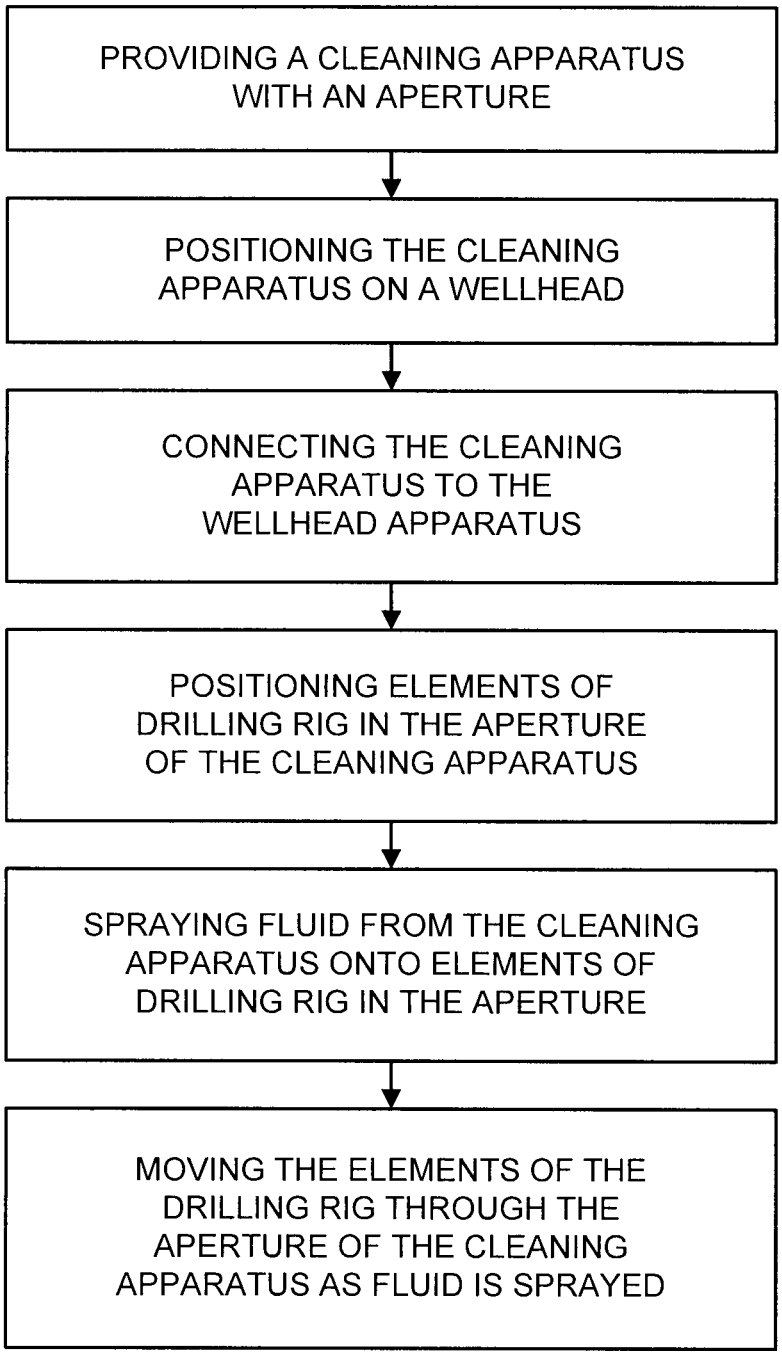
FIG. 17 is a schematic flow diagram of a process of using a cleaning apparatus of the present disclosure.

The disclosure also relates to a method of using cleaning apparatus such as is disclosed herein, as well as equivalent structures (see FIG. 17). In a broader sense, the disclosures relates to a method for applying a fluid to elements (such as drill pipe) of a drilling rig for the purpose of rinsing or cleaning the elements as they are moved through the wellhead of the well, such as when the elements are withdrawn from the borehole of the well. The cleaning apparatus may thus provide a continuous blast of high temperature high pressure fluid that strikes or otherwise impinges upon the elements, and tends to loosen and remove dirt, oil, drilling mud, and other debris on the surface of the elements and carry the debris in a downward direction under the influence of gravity back into the borehole of the well from which it came.

In some implementations, the method may comprise the provision of a cleaning apparatus having features such as are described in this specification, and which includes an aperture through which elements of a drilling rig, or other well related elements, may be moved. The method may include positioning the cleaning apparatus proximate to the borehole of the well, such as on the wellhead and may be incorporated as a part of the wellhead assembly. This step may include aligning the aperture of the cleaning apparatus with the borehole of the well such that elements moving out of the borehole also move through the aperture of the apparatus. In some implementations, the method includes stacking the cleaning apparatus in a stack of parts of the wellhead assembly, and may include connecting the cleaning apparatus to the parts of the wellhead assembly to form the cleaning apparatus as an integral part of the wellhead assembly.

The method may also include moving elements of the drilling rig through the aperture of the cleaning assembly, such as when the drilling elements are withdrawn from the borehole through the aperture of the cleaning apparatus as the apparatus is positioned in the wellhead assembly. The method also comprises spraying a fluid from the cleaning apparatus into the aperture of the apparatus as elements of the drilling rig are positioned in the aperture, such as when the element of the drilling rig is moved through the aperture as the element is withdrawn from the borehole. Spraying the elements with fluid as the elements are being withdrawn from the borehole may include spraying the fluid from nozzles into the aperture, and directing the fluid so that the streams converge or overlap, and optionally directing the fluid so that the fluid moves in an inwardly and downwardly direction in the aperture, and back into the bore of the wellhead assembly.

Significantly, the spraying of the fluid may be conducted in a manner such that the fluid remains in the central passage of the wellhead, and does not escape from the central passage. Debris such as dirt and fluids such as drilling mud may be substantially removed from the elements of the drilling rig prior to the elements being moved out of the central passage of the wellhead, such that debris and mud removal may be conducted in a substantially continuous manner as the elements are being lifted and withdrawn from the borehole of the well, while substantially confining the debris and fluids to the central passage and the borehole. The apparatus and method of the disclosure thus permits the elements to be cleaned prior to removing the elements from the wellhead, and avoids contamination of nearby soil and water bodies with drilling mud, oil, and other debris, and also avoids the need for transporting the elements (such as drill pipe) to another location for cleaning after the elements are outside of the wellhead. Thus, the use of the cleaning apparatus can help to prevent the escape of toxic and/or polluting materials from the wellhead onto the surrounding ground surfaces and equipment, thus limiting the impact of the drilling and operating process on the environment. For example, drilling fluids as well as oil may be confined to the borehole and wellhead without escape to the area surrounding the well. Further, the cleaning of the drilling elements may be performed simultaneous with the removal of the elements from the well, thus providing a time savings over cleaning operations performed as a separate step.

It should be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the disclosure.

We claim:

1. A cleaning system for employing with a wellhead of a well to spray elements positioned in a central passage of the wellhead, the cleaning system comprising:

a cleaning apparatus for mounting on the wellhead assembly, the cleaning apparatus defining an aperture in communication with the central passage of the wellhead assembly such that elements withdrawn from the wellhead pass through the aperture, the cleaning apparatus comprising:

an annular body including an inner surface defining at least a portion of the aperture of the cleaning apparatus, the annular body defining a fluid channel therein;

a plurality of orifices positioned on the annular body and oriented to direct fluid into the aperture, the orifices being in fluid communication with the fluid channel such that fluid carried in the fluid channel is moved through the orifices into the aperture;

wherein the fluid channel is incorporated into the annular body and extends substantially continuously about an entirety of the aperture of the cleaning apparatus; and a heated fluid generator removably connected to the cleaning apparatus in a manner to provide heated fluid to the fluid channel and orifices of the cleaning apparatus.

2. The apparatus of claim 1 wherein the orifices are located on the inner surface of the annular body.

3. The apparatus of claim 1 wherein the plurality of orifices are configured such that a stream of fluid exiting at least two of the orifices overlap.

4. The apparatus of claim 1 wherein the plurality of orifices are configured such that a stream of fluid exiting each of the orifices overlap at substantially the same location.

5. The apparatus of claim 1 wherein the plurality of orifices are configured such that streams of fluid exiting the orifices converge at an area located outside of the space between the planes of an upper opening and a lower opening of the aperture in the annular body.

6. The apparatus of claim 1 wherein the annular body comprises:

an upper portion having an upper face; and a lower portion connected to the upper portion, the fluid channel being formed by the upper and lower portions at the interface thereof.

7. The apparatus of claim 1 wherein the annular body comprises a first arcuate segment and a second arcuate segment separable from each other.

8. The system of claim 1 wherein the annular body includes at least two segments, each of the segments being connectable together to form a continuous ring about the aperture, and being disconnectable from each other to open the ring and permit moving of drilling elements into the aperture.

9. The system of claim 8 wherein the first and second segments are semicircular.

10. The system of claim 8 wherein the aperture through the body extends along a central axis, the annular body being divided into the first and second segments along a plane in which the central axis lies.

11. The system of claim 1 wherein the annular body includes an outer surface extending from an upper end of the body to a lower end of the body; and wherein the fluid channel is located between the inner surface and the outer surface.

12. The system of claim 1 additionally comprising a plurality of nozzles positioned at the orifices, each of the nozzles being located in an orifice channel outside of the aperture.

13. The system of claim 1 wherein a width of the aperture defined by the inner surface is substantially uniform from an upper opening to a lower opening of the body.

14. A wellhead assembly with an equipment cleaning apparatus, the assembly comprising:

a wellhead assembly defining a central passage through which drilling equipment is moved into and out of the well, the wellhead assembly comprising at least two stacked elements; and a cleaning apparatus mounted on the wellhead assembly, the cleaning apparatus defining an aperture in communication with the central passage of the wellhead assembly such that elements withdrawn from the wellhead pass through the aperture, the cleaning apparatus comprising:

an annular body including an inner surface, the annular body defining a fluid channel therein;

an inlet fitting on the annular body and in fluid communication with the fluid channel; and a plurality of orifices positioned on the annular body and oriented to direct fluid into the aperture, the orifices being in fluid communication with the fluid channel such that fluid carried in the fluid channel is moved through the orifices into the aperture;

wherein the inner surface of the annular body defines the aperture of the cleaning apparatus from an upper opening of the body to a lower opening of the body; and wherein the fluid channel connects at least two of the plurality of orifices and is incorporated into the annular body at a location radially outside of the inner surface.

15. The assembly of claim 14 wherein the plurality of orifices are configured such that streams of fluid exiting at least two of the orifices overlap.

16. The assembly of claim 14 wherein the plurality of orifices are configured such that streams of fluid exiting the orifices overlap at an area located outside of the space between the planes of an upper opening and a lower opening of the aperture of the cleaning apparatus.

17. The assembly of claim 14 wherein the annular body comprises a first arcuate segment and a second arcuate segment separable from each other.

18. The assembly of claim 14 wherein the fluid channel is incorporated into the annular body and extends substantially continuously about an entirety of the aperture of the annular body.

19. A cleaning system for employing with a wellhead of a well to spray elements positioned in a central passage of the wellhead, the cleaning system comprising:

a cleaning apparatus for mounting on the wellhead assembly, the cleaning apparatus defining an aperture in communication with the central passage of the wellhead assembly such that elements withdrawn from the wellhead pass through the aperture, the cleaning apparatus comprising:

an annular body including an inner surface defining at least a portion of the aperture, the annular body defining a fluid channel therein;

a plurality of orifices positioned on the annular body and oriented to direct fluid into the aperture, the orifices being in fluid communication with the fluid channel such that fluid carried in the fluid channel is moved through the orifices into the aperture; and a heated fluid generator removably connected to the cleaning apparatus in a manner to provide heated fluid to the fluid channel and orifices of the cleaning apparatus;

wherein the heated fluid generator is adapted to provide fluid to a plurality of distinct cleaning apparatus within a range of temperatures, a range of pressures, and a range of flow rates, the plurality of cleaning apparatus having at least two different numbers of orifices.

* * * * *